US007832887B2

(12) United States Patent
Battle

(10) Patent No.: US 7,832,887 B2
(45) Date of Patent: Nov. 16, 2010

(54) DOOR HANDLE AND LOCK ILLUMINATING DEVICE

(75) Inventor: Matt Battle, Canton, OH (US)

(73) Assignee: Lock Lights LLC, Canton, OH (US)

( * ) Notice: Subject to any disclaimer, the term of this patent is extended or adjusted under 35 U.S.C. 154(b) by 226 days.

(21) Appl. No.: 12/136,523

(22) Filed: Jun. 10, 2008

(65) Prior Publication Data

US 2008/0304251 A1 Dec. 11, 2008

Related U.S. Application Data

(60) Provisional application No. 60/943,296, filed on Jun. 11, 2007.

(51) Int. Cl.
*E05B 17/00* (2006.01)
*E05B 17/10* (2006.01)

(52) U.S. Cl. ..... 362/100

(58) Field of Classification Search ..... 362/100, 362/94, 137, 155, 191, 186, 234, 253
See application file for complete search history.

(56) References Cited

U.S. PATENT DOCUMENTS

| | | | | | |
|---|---|---|---|---|---|
| 3,955,075 | A | | 5/1976 | Susedik | 240/2.13 |
| 4,078,248 | A | | 3/1978 | Hill | 362/100 |
| 4,085,315 | A | | 4/1978 | Wolter et al. | 362/116 |
| 4,234,909 | A | | 11/1980 | Cotroneo | 362/100 |
| 4,276,582 | A | | 6/1981 | Burnett | 362/116 |
| 4,293,894 | A | * | 10/1981 | Blank | 362/100 |
| D262,241 | S | | 12/1981 | Meo | D3/63 |
| 4,310,873 | A | | 1/1982 | Bean | 362/100 |
| D263,651 | S | | 4/1982 | Meo | D3/63 |
| 4,467,402 | A | | 8/1984 | Bauer et al. | 362/32 |
| 4,777,570 | A | | 10/1988 | Littles | 362/100 |
| 4,779,171 | A | * | 10/1988 | Ferguson | 362/100 |
| 4,787,016 | A | | 11/1988 | Song | 362/116 |
| D304,130 | S | | 10/1989 | Song | D3/63 |
| 5,179,325 | A | | 1/1993 | Aragon, Jr. | 315/136 |
| 5,398,175 | A | | 3/1995 | Pea | 362/100 |
| 5,535,104 | A | | 7/1996 | Maffey et al. | 362/100 |
| 5,541,817 | A | | 7/1996 | Hung | 362/116 |
| 5,611,613 | A | * | 3/1997 | Bergen et al. | 362/555 |
| 6,164,795 | A | | 12/2000 | Lopez | 362/116 |
| 6,224,228 | B1 | | 5/2001 | Frederick | 362/116 |
| 6,439,732 | B1 | * | 8/2002 | Weisbach et al. | 362/100 |
| 6,655,811 | B2 | * | 12/2003 | Weisbach et al. | 362/100 |
| 6,729,740 | B1 | * | 5/2004 | Gazard | 362/100 |

* cited by examiner

*Primary Examiner*—Bao Q Truong
(74) *Attorney, Agent, or Firm*—McDonald Hopkins LLC; Michael J. Femal

(57) ABSTRACT

Apparatus, methods, and other embodiments associated with illuminating door handles and door lock mechanisms are described herein. In one embodiment of a door-illuminating device for illuminating a locking mechanism that is secured to a door and illuminating a door handle that is secured to the door, the device includes a housing, a light source, a source of power, a first opening in the housing, and a second opening in the housing. The housing is secured to the door and the light source and power source are secured within the housing, where the power source is in electrical communication with the light source. The first opening may selectively direct light emitted from the light source to the locking mechanism, and a second opening may selectively direct light emitted from the light source to the door handle.

10 Claims, 4 Drawing Sheets

DOOR HANDLE AND LOCK ILLUMINATING DEVICE

CROSS-REFERENCE TO RELATED APPLICATIONS

This application claims priority from U.S. Provisional Patent Application No. 60/943,296 entitled "DOOR KNOB AND LOCK ILLUMINATING DEVICE," filed on Jun. 11, 2007, which is hereby incorporated by reference in its entirety.

FIELD OF THE INVENTION

The present invention relates generally to apparatus and methods for illuminating doors, and more particularly relates to apparatus and methods for illuminating door handles and door lock mechanisms.

BACKGROUND OF THE INVENTION

Doors are commonly provided in homes, buildings, and other similar structures to allow for access to such structures. Doors commonly include key locks by which a door may be locked or unlocked and door handles by which the door may be opened and closed. When a door is positioned in poor lighting, such as after sunset or when a door is located in a hallway or other location lacking natural or artificial light, it may be challenging to lock or unlock and open or close a secured door. It is desirable to develop novel and improved apparatus for illuminating doors to facilitate the locking or unlocking and opening or closing of a door.

SUMMARY OF THE INVENTION

Apparatus, methods, and other embodiments associated with illuminating door handles and door lock mechanisms are described herein. In one embodiment of a door-illuminating device for illuminating a locking mechanism that is secured to a door and illuminating a door handle that is secured to the door, the device includes housing, a light source, a source of power, a first opening in the housing, and a second opening in the housing. The housing is secured to the door and the light source and power source are secured within the housing, where the power source is in electrical communication with the light source. The first opening may selectively direct light emitted from the light source to the locking mechanism, and the second opening may selectively direct light emitted from the light source to the door handle.

DETAILED DESCRIPTION

While the invention is described herein with reference to a number of embodiments and methods of use, it should be understood that the invention should not be limited to such embodiments or uses. The description of the embodiments and uses herein are illustrative only and should not limit the scope of the invention as claimed. Embodiments are presented in the figures, which are not drawn to scale and in which like components are numbered alike.

Apparatus for illuminating the locking mechanism and the door handle of a door and methods of using such apparatus may be arranged such that both the locking mechanism and door handle may be illuminated to facilitate the locking or unlocking and opening or closing of a door under poor lighting conditions. Such apparatus and methods of use may be arranged to simultaneously illuminate both the locking mechanism and the door handle. In addition, such apparatus may be arranged to selectively illuminate either the locking mechanism or the door handle of a door, or selectively illuminate both the locking mechanism and the door handle of a door.

Figure 1:
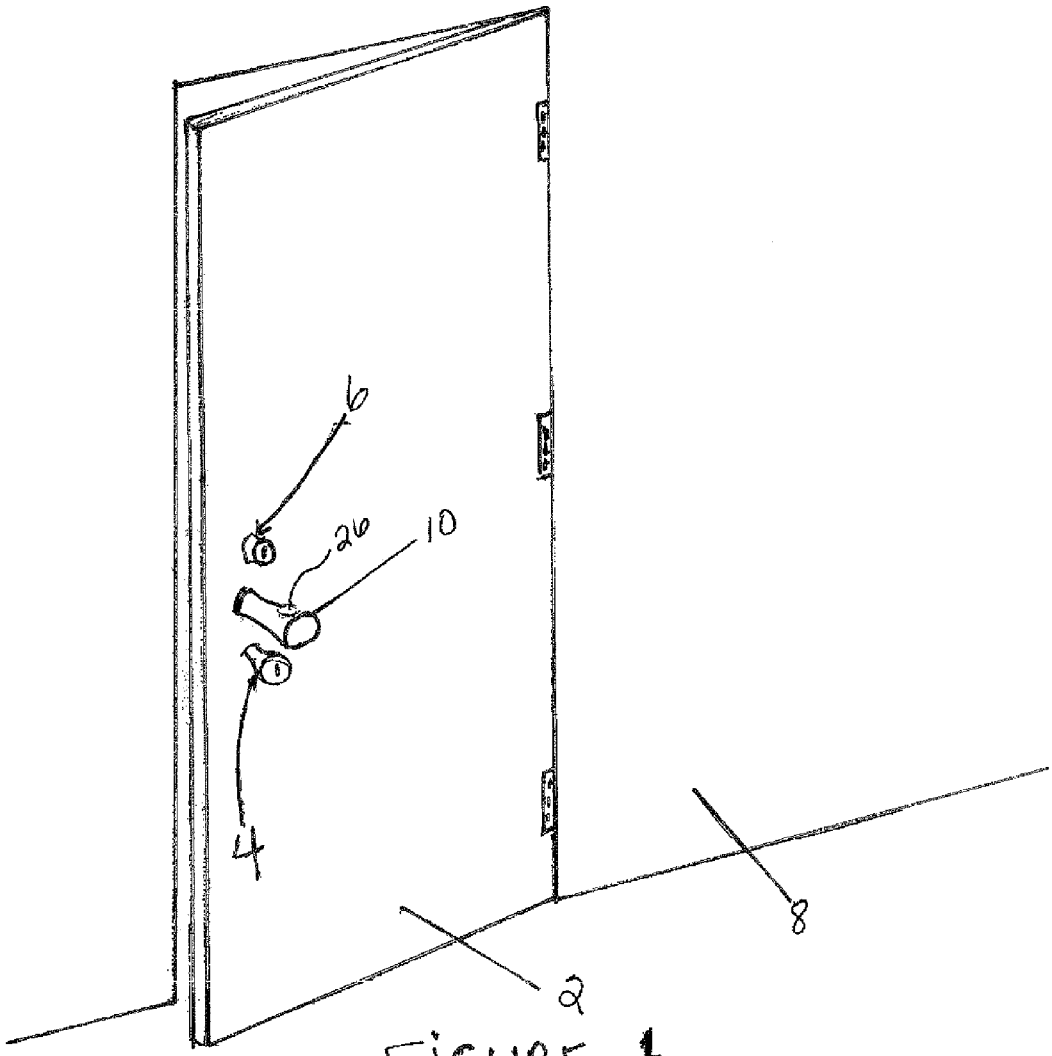
FIG. 1 is an isometric view of a door-illuminating device secured to a door.

FIG. 1 schematically illustrates an exemplary embodiment of a door-illuminating device 10. As may be seen, the door-illuminating device is attached to, secured to, or otherwise coupled to a door 2. The door 2 may include a door handle 4 and a locking mechanism 6 and may be arranged to secure a doorway in a structure 8 such as a home or building. In the illustrative example of FIG. 1, the door handle 4 is a doorknob and the locking mechanism 6 is a deadbolt lock. The doorknob 4 and deadbolt lock 6 are positioned a distance away from each other, which presents a challenge for a device designed to illuminate both the doorknob 4 and deadbolt lock 6.

The door-illuminating device 10 is secured to the door 2 at a location between the doorknob 4 and the deadbolt lock 6. In an embodiment, the door-illuminating device 10 may be positioned generally equidistant between the doorknob 4 and the deadbolt lock 6. However, the door-illuminating device 10 may be positioned anywhere, provided it remains capable of illuminating at least either a door handle 4 or a locking mechanism 6 of a door 2. In an embodiment, the door-illuminating device 10 is arranged such that both the door handle 4 and the locking mechanism 6 may simultaneously be illuminated.

The illumination of the door handle 4 and the locking mechanism 6 by a door-illuminating device 10 not only eases and facilitates the process of locking or unlocking and opening or closing of a door 2, it may also serve as an important safety measure. For example, illumination of the lock 6 and handle 4 may allow a user or operator of the door 6 to quickly unlock a door 2 and enter a structure 8 to avoid a hazard.

Figure 2:
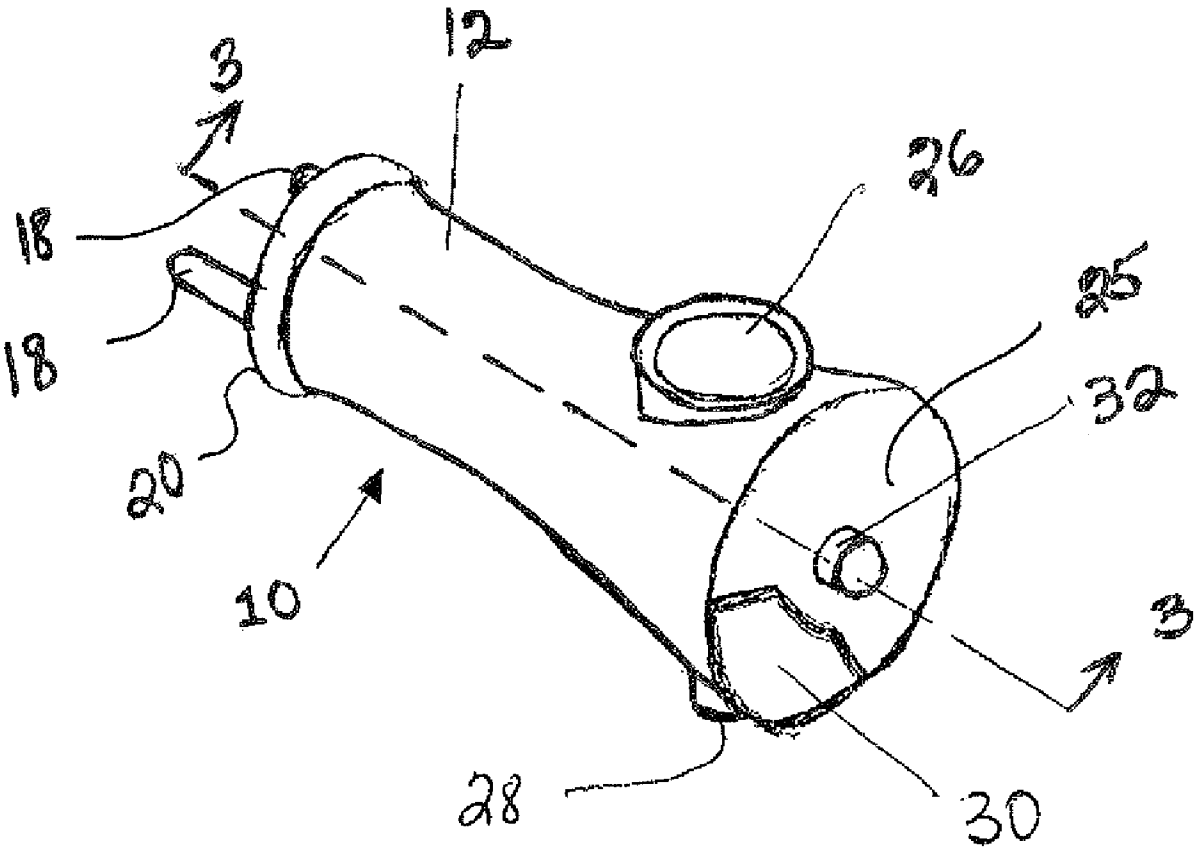
FIG. 2 is an isometric view of a door-illuminating device.
Figure 3:
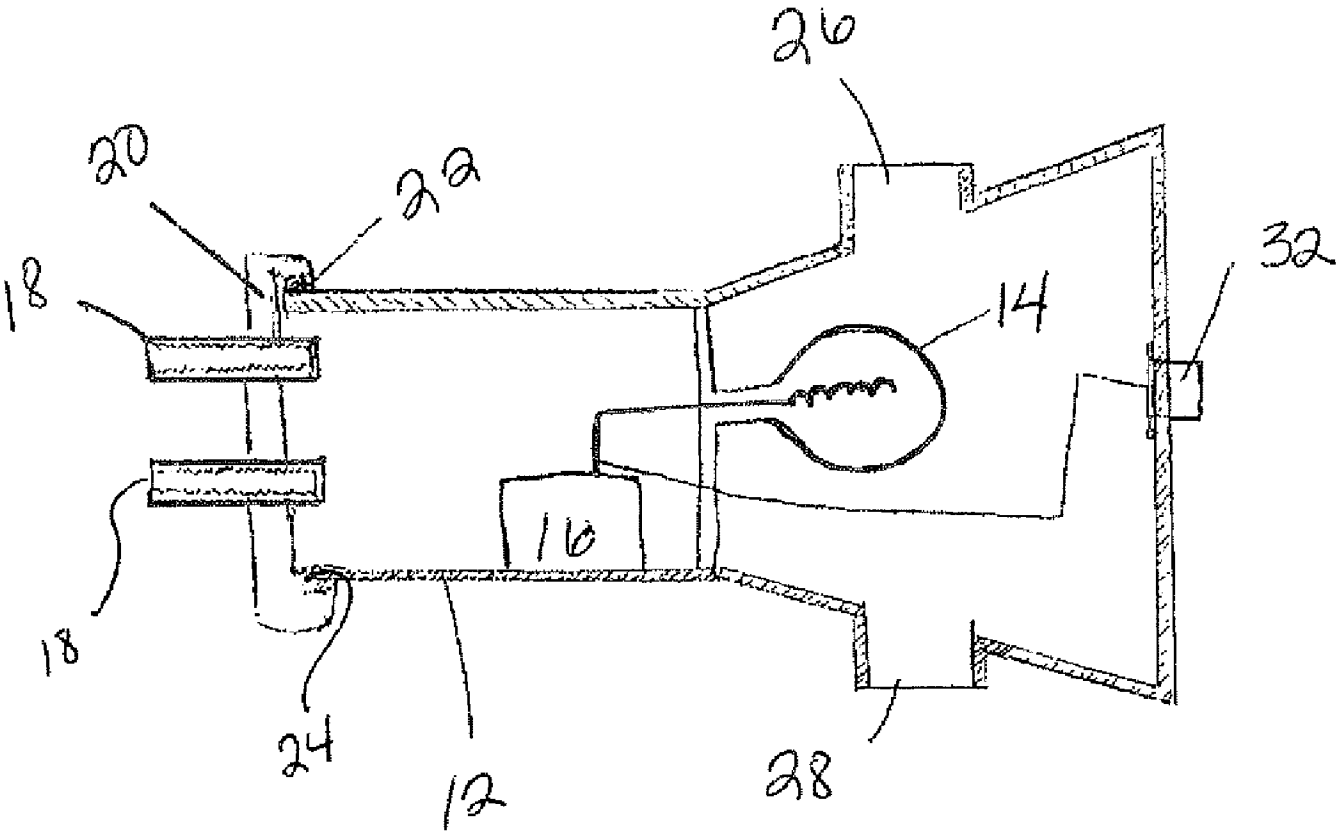
FIG. 3 is a cross-sectional view of the door-illuminating device of FIG. 2 taken along the line 3-3 of FIG. 2.

FIGS. 2 and 3 schematically illustrate a detailed exemplary embodiment of a door-illuminating device 10. The door-illuminating device 10 may include a housing 12 for securing and protecting internal component of the device 10. The device 10 may also include a light source 14 positioned and secured within the housing 12 and a power source 16 for providing power to the light source 14, also positioned and secured within the housing 12. The light source 14 may be, for example, an incandescent bulb, fluorescent bulb, halogen bulb, light emitting diode, or any type of device capable of emitting light. The power source 16 may be a battery, capacitor, or any other device that is capable of storing energy or power and delivering that energy or power to the light source 14 to illuminate the light source 14. In an embodiment, a light source 14 may be hard wired to an electrical grid to provide power to illuminate the light source 14.

The housing 12 may be arranged to mount, attach, or otherwise couple to the door 2 to secure the door-illuminating device 10 to the door 2. Securing of the door-illuminating device 10 to the door 2 may be arranged so that the door-illuminating device 10 is secured proximately to the door handle 4 and the locking mechanism 6. The housing 12 may include securing features 18 to facilitate securing the device 10 to a door 2. Such securing features 18 may be, for example, internally threaded posts that extend from the housing 12. The threaded posts 18 may be arranged to accept threaded fasteners such as bolts or screws to secure the housing 12 to the door 2, thus securing the door-illuminating device 10 to the door 2. The threaded posts 18 may be positioned in pre-drilled apertures in the door 2 and bolts may be threaded into the posts 18 from the opposite side of the door 2.

In an embodiment, the securing features 18 may be positioned on a mounting plate 20 that is secured to the end of the housing 12 that is designed to abut the door 2. The mounting plate 20 may be secured to the housing 12 such that it is removable from the end of the housing 12. For example, the mounting plate 20 and housing 12 may both be generally cylindrical in shape to facilitate the mounting of the plate 20 onto the housing 12. As best seen in FIG. 3, an internal surface 22 of the mounting plate 20 may be treaded and an external surface 24 of the housing 12 may also be treaded to match and engage the threads of the plate 20. In such an arrangement, the mounting plate 20 may be secured to the housing 12 by engaging the threads and turning the plate 20 with respect to the housing 12. Thus, when the mounting plate 20 is secure to a door 2 via the fastening features 18, the housing 12 may be removed from the mounting plate 20 by turning the housing 12 with respect to the plate. This allows the housing 12 to be removed from the door 2, while the mounting plate 20 remains secured to the door 12. Such an arrangement may facilitate the replacement of internal components of the door-illuminating device 10 such as the light source 14 and power supply 16. Such an arrangement may also provide for general maintenance of the device 10.

As best seen in FIG. 2, in an embodiment, the door-illuminating device 10 may include a faceplate 25 located opposite the mounting plate 20. The faceplate 25 may be arranged such that it is removably attached to the housing 12. The faceplate 25 may be arranged to be removable from the housing 12 in a similar fashion to the arrangement described for the mounting plate 20. Again, similar to the mounting plate 20, removability of the faceplate 25 from the housing 12 may facilitate the replacement of components that are internal to the housing 12 such as the light source 14 and power supply 16, and provide for general maintenance of the device 10.

In an embodiment, the housing 12 is manufactured or otherwise fabricated from a generally opaque material that does not allow a substantial amount of light from the light source 14 to pass through the body of the housing 12. In such an embodiment, the housing 12 may include a number of openings in the body to allow light generated by the light source 14 to pass through the body of the housing 12. As best seen in FIG. 3, the housing 12 may include a first opening 26 in the top of the housing 12 and a second opening 28 in the bottom of the housing 12. When the door-illuminating device 10 is secured to a door 2 between a door handle 4 and a locking mechanism 6 (as shown in FIG. 1), the first and second openings 26, 28 in the housing 12 may be arranged such that light from the internal light source 14 is directed simultaneously through the first opening 26 to the locking mechanism 6 and through the second opening 28 to the door handle 4.

In an embodiment, the housing 12 may further include a third opening 30 located in the faceplate 25 of the door-illuminating device 10 facing away from the door 2 (as shown in FIG. 2). Such an arrangement may direct light from the internal light source 14 to illuminate an area in front of the door 2. Such illumination may provide for an operator or user to view multiple keys on a key ring and choose the correct key to open the door 2. Although the figures and description illustrate and describe three openings 26, 28, 30 in the housing 12, it will be readily understood by those skilled in the art upon reviewing this disclosure that a housing of a door illuminating device may be arranged to include any number of openings for directing light generated by the internal light source 14. In addition, such openings may be positioned anywhere upon the housing. For example, openings may be positioned to direct light to the left or right of the door 2 (with respect to FIG. 1). In an embodiment a transparent or semi-transparent material may enclose the openings. For example, a plastic or glass window may be positioned or secured within an opening. Such an arrangement may allow light to emit from the door-illuminating device 10 while preventing debris or other such substances from entering the housing 12.

The light source 14 has been illustrated in the figures as a single bulb. However, it will be readily understood by those skilled in the art upon reviewing this disclosure that the light source of a door illuminating device may include multiple bulbs, diodes, or the like. In one example, the light source may be arranged such that an individual bulb may be positioned proximate to each opening in the housing. Such arrangement may farther facilitate the directing of light to desired areas such as, for example, a door handle 4, a locking mechanism 6, the area in front of the door 2, and the like.

The door-illuminating device 10 may be arranged to allow a user to selectively illuminate the light source 14. In one embodiment a manual switch 32 may be positioned on the housing 12 such that the switch is accessible by an operator. In an example, a toggle button 32 may be positioned on the faceplate 25 of the door-illuminating device 10 (as best seen in FIGS. 2 and 3). The button 32 may be arranged such that the operator may upon arriving at the door 2 depress the button 32 to initiate the delivery of power to the light source 14 to illumination of the light source 14. The light may be directed to the locking mechanism 6 and door handle 4 to assist the operator in unlocking and opening the door 2. Once the operator has unlocked the locking mechanism 6 and opened the door 2, the operator may again depress the button 32 to turn off the light source 14 to conserve energy in the power supply 16.

Figure 4:
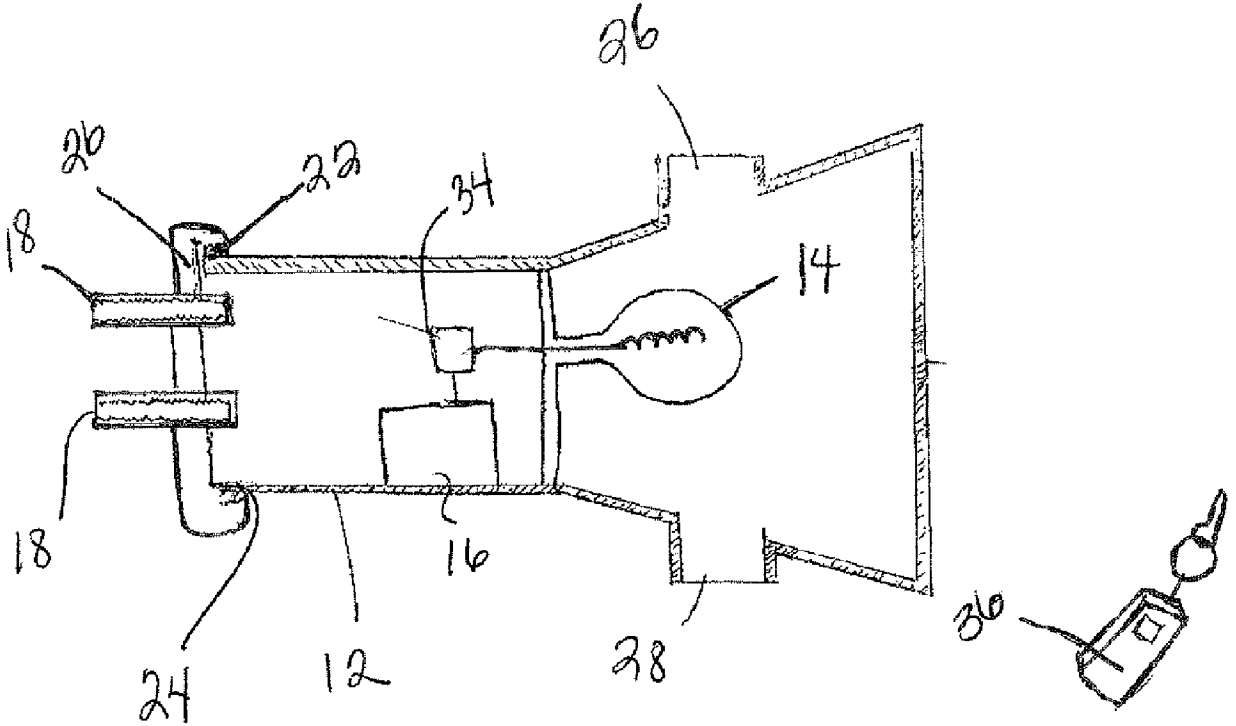
FIG. 4 is a cross-sectional view of a door-illuminating device.

As shown in FIG. 4, in an embodiment the door-illuminating device 10 includes a receiver 34 positioned within the housing 12. The receiver 34 is positioned between the light source 14 and the power source 16. The receiver 34 may be remotely manipulated by a transmitter 36 through wireless communications to direct the power source 16 to illuminate the light source 14 or direct the power source 16 to turn off the light source 14. The transmitter 36 may be arranged such that it is portable and an operator may carry the transmitter 36. For example, the transmitter 36 may be arranged to be secured to a keychain that also holds the key that unlocks the door 2. A receiver 34 and transmitter 36 arrangement allows a user to illuminate the locking mechanism 16 and door handle 14 remotely such as, for example, as the user is approaching the door 2 with the intention of unlocking and opening the door 2.

In an embodiment, the door-illuminating device 10 may be arranged such that the light source 14 is automatically turned on and turned off. In one example, a timing mechanism (not shown) may be coupled to the power supply 16 such that an operator may arrange the timing mechanism such that the light source 14 is turned on at a predetermined time and the light source 14 is turned off at another predetermined time. Such predetermined times may be, for example, at sunset and sunrise.

In another embodiment, a photosensitive sensor (not shown) may be coupled to the power supply 16. The photosensitive sensor may be arranged such that when the absence of natural and artificial light is detected, the light source 14 is illuminated and when natural or artificial light is detected generally outside the housing 12 the light source 14 is turned off.

In another embodiment, a motion sensor mechanism (not shown) may be coupled to the power supply 16. The motion sensing mechanism may be arranged such that the mechanism detects motion proximate to the door 2. Upon the sensing of motion, the mechanism may send a signal to the power source 16 to illuminate the light source 14. When the door 2 is unlocked and opened or when a predetermined about of time has passed since motion was last detected, the mechanism may send a signal to the power source 16 to turn the light source 14 off.

In another embodiment, an activator sensing mechanism (not shown) may be coupled to the power supply 16. The activator sensing mechanism may be arranged such that when it senses an activator in the proximity of the door 2, a signal is sent to the power source 16 to illuminate the light source 14. When the activator sensing mechanism no longer senses the activator, a signal is sent to the power source 16 to turn off the light source 14. The activator may be attached to the key that opens the door lock 6 or attached to a keychain that holds the key that opens the door lock 6. In one example, the activator and activator sensing mechanism may be based on radio frequency identification technology ("RFID"). A unique RFID tag may be affixed to the door lock key or a key chain holding the door lock key and a RFID reader may be secured within the housing 12. When the RFID reader detects the unique RFID tag in the proximity of the door 2, a signal is sent to illuminate the light source 14. Once the RFID tag is not longer in the proximity of the door 2, a signal is sent to turn off the light source 14.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however; such values and ranges are not to be construed in a limiting sense and are intended to be critical values or ranges only if so expressly stated.

Having described the invention, I claim:

1. A door-illuminating device for illuminating a locking mechanism that is secured to a door and illuminating a door handle that is secured to the door, the device comprising:

a housing secured to the door;

a light source secured within the housing;

a source of power secured within the housing and in electrical communication with the light source;

a first opening in the housing for selectively directing light emitted from the light source to the locking mechanism; and a second opening in the housing for selectively directing light emitted from the light source to the door handle.

2. The door-illuminating device of claim 1, where the housing is secured to the door at a location between the locking mechanism and the door handle.

3. The door-illuminating device of claim 1, further comprising a faceplate removably coupled to a first end of the housing and a mounting plate coupled to a second end of the housing, where the mounting plate secures the housing to the door.

4. The door-illuminating device of claim 3, further comprising a third opening in the faceplate for selectively directing light emitted from the light source to an area adjacent to the door.

5. The door-illuminating device of claim 3, further comprising at least one securing feature coupled to the mounting plate and a fastener, where the fastener engages the securing feature to secure the housing to the door.

6. The door-illuminating device of claim 1, further comprising a transparent window enclosing the first opening.

7. The door-illuminating device of claim 1, further comprising a switch in electrical communication with the source of power.

8. The door-illuminating device of claim 1, further comprising a receiver in electrical communication with the source of power and a transmitter in selective wireless communication with the receiver.

9. The door-illuminating device of claim 1, further comprising a timing mechanism in electrical communication with the source of power.

10. The door-illuminating device of claim 1, further comprising a motion sensing mechanism in electrical communication with the source of power.

* * * * *